US009604818B2

(12) United States Patent
Kallioniemi et al.

(10) Patent No.: US 9,604,818 B2
(45) Date of Patent: Mar. 28, 2017

(54) METHOD FOR MONITORING THE OPERATING CONDITION OF AN ELEVATOR SYSTEM ON THE BASIS OF FREQUENCY COMPONENT

(71) Applicant: KONE CORPORATION, Helsinki (FI)

(72) Inventors: Antti Kallioniemi, Jokela (FI); Tuukka Kauppinen, Suzhou (CN)

(73) Assignee: KONE CORPORATION, Helsinki (FI)

( * ) Notice: Subject to any disclaimer, the term of this patent is extended or adjusted under 35 U.S.C. 154(b) by 630 days.

(21) Appl. No.: 14/025,648

(22) Filed: Sep. 12, 2013

(65) Prior Publication Data

US 2014/0027209 A1 Jan. 30, 2014

Related U.S. Application Data

(63) Continuation of application No. PCT/FI2012/050278, filed on Mar. 21, 2012.

(30) Foreign Application Priority Data

Apr. 1, 2011 (FI) ..... 20115316

(51) Int. Cl.
*B66B 1/34* (2006.01)
*B66B 5/00* (2006.01)

(52) U.S. Cl.
CPC ..... *B66B 5/0018* (2013.01); *B66B 5/0025* (2013.01)

(58) Field of Classification Search
CPC ..... B66B 5/0018; B66B 5/0025
USPC ..... 187/247, 277, 280–288, 391, 393, 293, 187/296, 297, 292
See application file for complete search history.

(56) References Cited

U.S. PATENT DOCUMENTS 5,076,996 A 12/1991 Miyaguchi et al.
5,522,480 A * 6/1996 Hofmann ..... B66B 1/3492 187/288
5,765,663 A * 6/1998 Jamieson ..... B66B 11/028 187/292
6,854,565 B2 * 2/2005 Perala ..... B66B 5/0006 187/247
7,740,112 B2 * 6/2010 Iwata ..... B66B 1/285 187/295
7,823,706 B2 * 11/2010 Tyni ..... B66B 5/0031 187/391

(Continued)

FOREIGN PATENT DOCUMENTS

CN 200999167 Y 1/2008
EP 0776855 A1 6/1997

(Continued)

*Primary Examiner* — Anthony Salata
(74) *Attorney, Agent, or Firm* — Birch, Stewart, Kolasch & Birch, LLP

(57) ABSTRACT

An elevator system and a method for monitoring the operating condition of an elevator system are provided. In the method, samples are taken of the control signal of the drive device of the elevator, from the series of samples taken a frequency component is determined that is characteristic to the part of the elevator assembly driven with the drive device, and also the operating condition of the part of the elevator assembly is monitored on the basis of the determined frequency component.

20 Claims, 4 Drawing Sheets

(56) References Cited

U.S. PATENT DOCUMENTS

| | | | | |
|---|---|---|---|---|
| 7,909,144 | B2 * | 3/2011 | Fukui | B66B 5/02 187/292 |
| 7,954,607 | B2 * | 6/2011 | Kallioniemi | B66B 5/06 187/287 |
| 8,141,685 | B2 * | 3/2012 | Utsunomiya | B66B 7/042 187/292 |
| 8,418,815 | B2 * | 4/2013 | Encinas Carreno | B66B 5/0025 187/247 |
| 8,540,057 | B2 * | 9/2013 | Schuster | B66B 1/34 187/247 |
| 8,579,089 | B2 * | 11/2013 | Hakala | B66B 1/24 187/278 |
| 8,893,858 | B2 * | 11/2014 | Shi | 187/247 |
| 9,309,089 | B2 * | 4/2016 | Annen | B66B 3/00 |
| 2003/0217894 | A1 | 11/2003 | Perala et al. | |
| 2005/0230191 | A1 | 10/2005 | Heinzer et al. | |
| 2007/0016332 | A1 | 1/2007 | Tyni et al. | |
| 2009/0218176 | A1 | 9/2009 | Tyni et al. | |

FOREIGN PATENT DOCUMENTS

| | | | |
|---|---|---|---|
| GB | 212749 | A | 1/1984 |
| JP | 6-156902 | A | 6/1994 |
| JP | 7-228443 | A | 8/1995 |
| JP | 8-324906 | A | 12/1996 |
| JP | 2003-327366 | A | 11/2003 |

* cited by examiner

15: Cascade regulator
20: Elevator control unit
21: Elevator car
23: Counterweight
40: Program module
42: Pulse encoder 9: Movement profile
16: Speed regulator
17: Current regulator
19: Conversion segment
27: Conversion segment
42: Pulse encoder 10: Frequency converter
29: Door panel
41: Brushless direct-current motor

METHOD FOR MONITORING THE OPERATING CONDITION OF AN ELEVATOR SYSTEM ON THE BASIS OF FREQUENCY COMPONENT

FIELD OF THE INVENTION

The invention relates to the monitoring of the operating condition of an elevator system.

BACKGROUND OF THE INVENTION

An elevator and a possible counterweight are suspended in an elevator hoistway on suspension ropes. The force for driving the elevator car is produced with a rotating hoisting machine, and the force produced is transmitted to the elevator car/counterweight with ropes that travel in the rope grooves of the traction sheave of the hoisting machine. The same ropes can be used for both the suspension and the driving of the elevator car; on the other hand, the elevator system can also comprise wholly or partly separate ropes for the suspension and for the driving of the elevator car. In addition, the elevator system can also comprise, inter alia, one or more compensating ropes, the purpose of which is to reduce the force difference caused from the asymmetrical weight distribution of the elevator roping on the different sides of the traction sheave.

One or more rotating diverting pulleys, via which the ropes pass, can be fixed to the structures of the elevator hoistway, to the machine room (if an elevator system with machine room is involved) and into connection with the elevator car and the counterweight. By the aid of the diverting pulleys both the passage of the ropes can be guided and the suspension ratio can also be changed, which affects the magnitude of the rope force caused from the load to be moved.

In addition to a hoisting machine/diverting pulleys, the elevator system also comprises other parts, which when operating rotate at their certain natural frequency. Such parts are e.g. the rotor of the drive machinery of the door of the elevator car and also the track rollers, which support and guide the movement of the door panels in connection with opening/closing of the door.

The components belonging to an elevator assembly wear and might also fail over the course of time. For example, wearing of the bearings of the hoisting machine and of the diverting pulleys might cause noise problems and gradually also a deterioration of the ride comfort of the elevator. The noise caused from operation of the door operator can increase to be disturbing when the operating condition of the bearings of the rotor of the door operator and of the bearings of the track rollers deteriorates. Also damaging of the coating of the traction sheave, a diverting pulley and a track roller might cause a noise problem/weaken ride comfort.

AIM OF THE INVENTION

The aim of the invention is to solve the problems caused from wearing/failure of the components of an elevator assembly, more particularly by developing the condition monitoring of an elevator. To achieve this aim the invention discloses a method according to claim 1 for monitoring the operating condition of an elevator system and also an elevator system according to claim 10. Some inventive embodiments and inventive combinations of the various embodiments are also presented in the descriptive section and in the drawings of the present application.

SUMMARY OF THE INVENTION

In the method according to the invention for monitoring the operating condition of an elevator system, samples of the control signal of the drive device of the elevator are taken when driving a part of the elevator assembly with the aforementioned drive device, from the series of samples taken a frequency component is determined that is characteristic to the part of the elevator assembly driven with the drive device, and also the operating condition of the part of the elevator assembly is monitored on the basis of the determined frequency component. The aforementioned part of an elevator assembly is preferably a rotating part of the elevator assembly.

In a preferred embodiment of the invention one or more limit values are formed for a frequency component, the aforementioned one or more limit values are compared to the determined frequency component, and the operating condition of a part of the elevator assembly is monitored on the basis of the comparison.

In a preferred embodiment of the invention, if the determined frequency component deviates from the permitted range specified with the limit values, it is deduced that the operating condition of the part in question of the elevator assembly has deteriorated.

In a preferred embodiment of the invention the remaining service life of a part of the elevator assembly is determined based on the magnitude of the deviation from the permitted range of the determined frequency component and a monitoring signal is formed for indicating the remaining service life of the part of the elevator assembly.

In a preferred embodiment of the invention, if it is detected that the operating condition of a part of the elevator assembly has deteriorated, a monitoring signal is formed for specifying the part of the elevator assembly having a deteriorated operating condition. In some embodiments information about the determined cause of the failure is added to the monitoring signal, e.g. information about a failed bearing, an installation error, damage of the friction coating of a rotating part made of a plastic compound, et cetera.

In a preferred embodiment of the invention the drive device is an electric motor and in the method the moment of sampling the control signal of the electric motor is synchronized with the angle between the rotor and the stator of the electric motor, and also a frequency component is determined from the series of samples using a DFT algorithm. When proceeding in this manner, the control signal does not need to be processed with a separate window function before determination of the frequency component with a DFT algorithm.

In a preferred embodiment of the invention the movement of a rotating part of the elevator assembly is adjusted with the drive device according to a movement profile to be set for the movement of the rotating part, the operating condition of the rotating part of the elevator assembly is monitored with the method according to the invention, and also the movement profile of the rotating part of the elevator assembly is changed on the basis of a change detected in the operating condition of the rotating part of the elevator assembly.

In a preferred embodiment of the invention a frequency component characteristic to a rotating part of an elevator assembly is adjusted towards a permitted range of the frequency component by changing the movement profile of the rotating part of the elevator assembly in response to the magnitude of the deviation from the permitted range of the frequency component determined from the series of samples.

In a preferred embodiment of the invention samples of the control signal of the drive device of the elevator are taken when driving one or more parts of the elevator assembly with the aforementioned drive device, a plurality of frequency components characteristic to one or more parts of the elevator assembly is selected, from the series of samples taken the aforementioned frequency components are determined, and also the operating condition of the one or more parts in question of the elevator assembly is monitored on the basis of the determined frequency components.

The elevator system according to the invention comprises a controllable drive device, which is configured to drive one or more parts of the elevator assembly; and also a control device for controlling the drive device. The aforementioned control device is configured to perform a method according to the invention for monitoring the operating condition of the elevator system.

In a preferred embodiment of the invention the drive device is an electric motor of the hoisting machine of an elevator. In some embodiments of the invention a part of the elevator assembly is the traction sheave of the hoisting machine. In some embodiments of the invention a part of the elevator assembly is a diverting pulley of an elevator.

In a preferred embodiment of the invention the drive device is an electric motor of the door operator of an elevator. In some embodiments of the invention a part of the elevator assembly is the traction sheave of the door operator of an elevator. In some embodiments the aforementioned part of an elevator assembly is a diverting pulley of a door operator. In some embodiments the aforementioned part of an elevator assembly is a suspension roller of a door.

In some embodiments an acceleration sensor is fitted in connection with the door operator of an elevator and the drive unit of the door operator is configured to monitor the operating condition of a part of the elevator assembly on the basis of a frequency component determined from the measuring signal of the acceleration sensor.

In some embodiments an acceleration sensor is fitted in connection with the drive unit of the lighting of an elevator car and the drive unit of the lighting is configured to monitor the operating condition of a part of the elevator assembly on the basis of a frequency component determined from the measuring signal of the acceleration sensor.

By means of the invention the deterioration of the operating condition of a part, such as of a traction sheave, diverting pulley or track roller, of an elevator assembly can be detected in good time, even before it has an essential effect on the operability of the elevator. The part or the part type deteriorating in its operating condition can also be specified and advance information, with details of the part type, about the repair need can be sent to a servicing center, in which case the spare part needed can be procured and delivered in good time for optimizing the repair time. By means of the invention also an estimate of the remaining service life of a part/parts can be produced for forecasting and prioritizing maintenance work.

According to the invention the operation of an elevator can also be continued with an adapted, preferably limited, movement profile despite a deterioration of the operating condition of a part of the elevator assembly. For example, a disturbing noise or vibration caused by a bearing defect of the traction sheave can be reduced by decreasing the speed of rotation of the bearing, in which case operation of the elevator within the permitted noise levels and vibration levels is possible at limited speed while awaiting servicing of the failed part(s).

The aforementioned summary, as well as the additional features and advantages of the invention presented below, will be better understood by the aid of the following description of some embodiments, said description not limiting the scope of application of the invention.

MORE DETAILED DESCRIPTION OF PREFERRED EMBODIMENTS OF THE INVENTION

Embodiment 1

Figure 1:
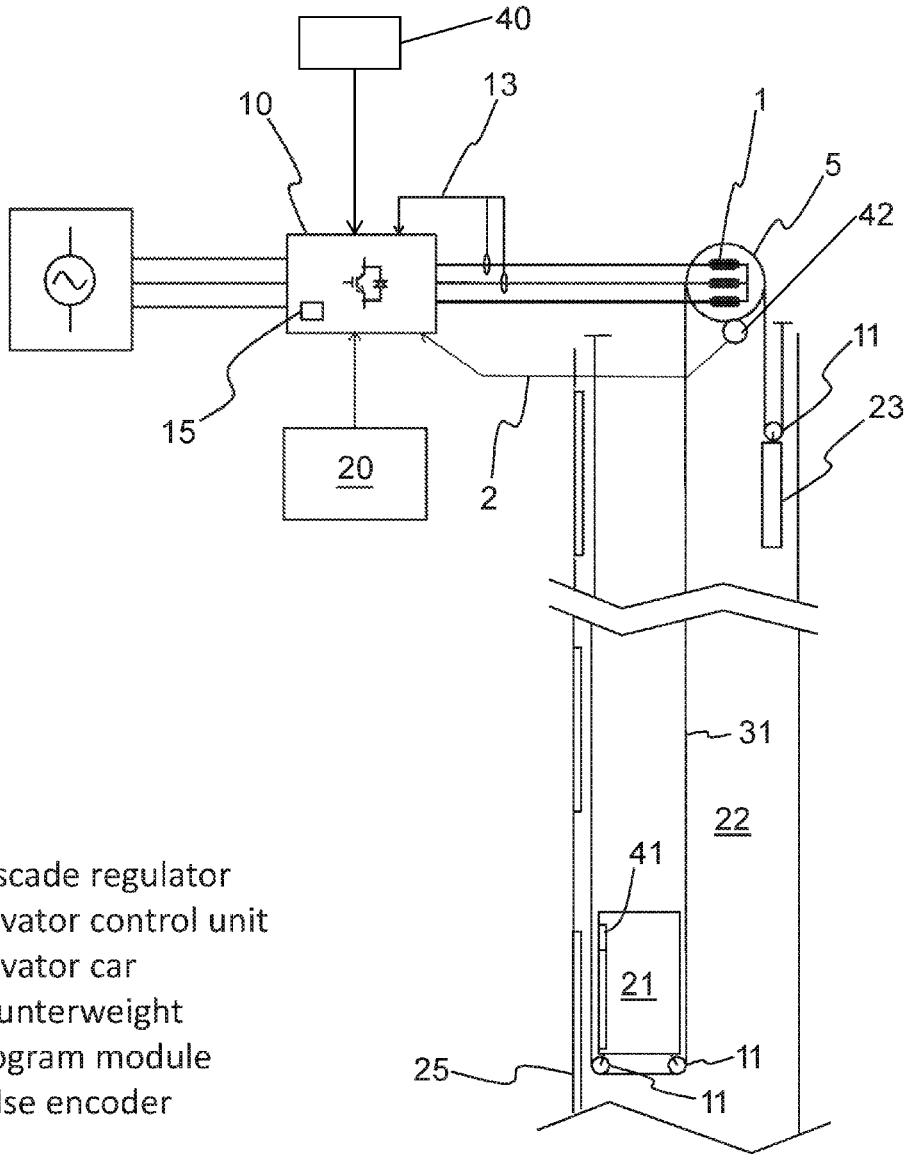
FIG. 1 presents as a block diagram an elevator system according to the invention

In the elevator system of FIG. 1, the elevator car 21 is suspended with ropes 31 passing via the traction sheave 5 of a hoisting machine that is in the top part of the elevator hoistway 22. Metal ropes, or e.g. a belt, can be used as the ropes, inside the matrix supporting the structure of which ropes are fitted tractive strands, such as metal strands or synthetic fibers. The suspension ratio of the elevator system is 2:1, and the suspension ropes 31 travel from the traction sheave 5 via the diverting pulleys 11 fixed to the bottom support structure of the elevator car and onwards back to the top part of the elevator hoistway 22. The suspension ropes 31 also travel from the traction sheave 5 to a diverting pulley 11 adjoined to the counterweight 23, and from the diverting pulley 11 of the counterweight back to the top part of the elevator hoistway. The ends of the suspension ropes 31 are fixed to a fixed structure in the top part of the elevator hoistway.

The hoisting machine of the elevator comprises a permanent-magnet synchronous motor 1 as the power-producing part, the rotor of which is integrated into the same piece as the traction sheave 5. With the permanent-magnet synchronous motor 1 are driven the traction sheave 5, the suspension ropes 31 engaged by frictional traction with the traction sheave 5, the diverting pulleys 11, et cetera, for driving the elevator car 21 in the elevator hoistway.

The elevator car 21 is moved and supported in the elevator hoistway 22 by adjusting the input power of the permanent-magnet synchronous motor 1, and at the same time the torque of the traction sheave 5, with a frequency converter 10 connected to an electricity network.

Figure 2:
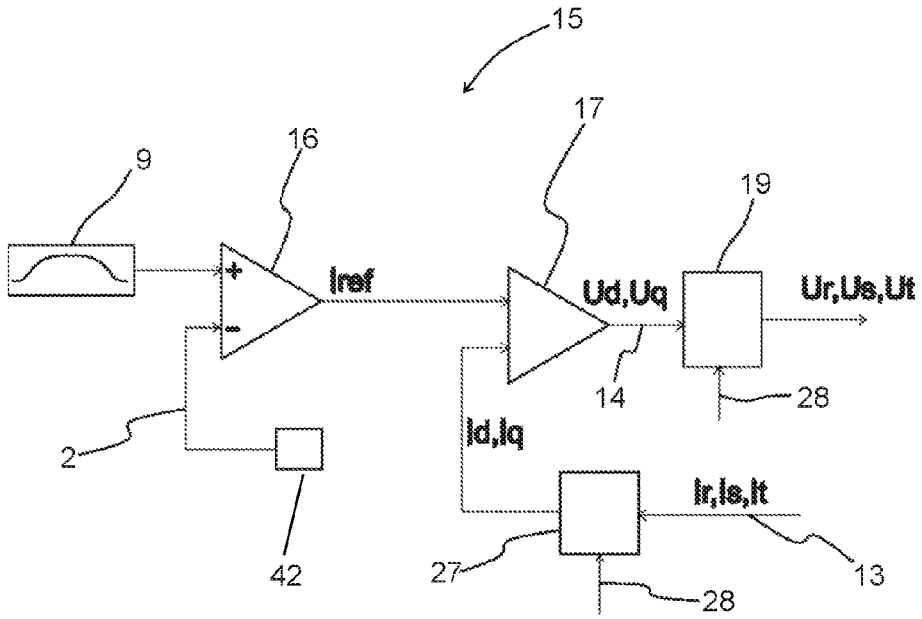
FIG. 2 illustrates one control principle of a drive device according to the invention

The elevator control unit 20 controls the movement of the elevator car between the floor levels 25 in response to elevator calls. For this purpose the elevator control unit 20 forms a movement profile 9, according to which the elevator car 21 is moved during a run. The speed of a starting elevator car is first accelerated to the rated speed, after which the elevator car 21 is driven at the rated speed until the speed of the elevator car is gradually started to be decelerated and the elevator car is stopped at the destination floor. The elevator control unit sends the movement profile 9 of the elevator car it has formed to the frequency converter 10, which reads the speed signal 2 of the traction sheave and adjusts the speed of the traction sheave towards the aforementioned movement profile 9 by adjusting the torque of the permanent-magnet synchronous motor 1 with a cascade regulator 15. The speed of the traction sheave 5 can be measured e.g. with a pulse encoder 42. FIG. 2 presents the operation of the cascade regulator 15 of a permanent-magnet synchronous motor 1 in more detail. The cascade regulator comprises two nested regulating loops, an outer speed-regulating loop and an inner torque-regulating loop. The speed regulator 16 forms a current reference Iref in the direction of the torque axis of the permanent-magnet synchronous motor on the basis of the error variable of the speed reference 9 and the speed signal 2 of the traction sheave. The current reference Iref, which is also the torque reference for the permanent-magnet synchronous motor, is taken to the current regulator 17. The current regulator 17 forms a voltage reference 14 for the stator winding of the permanent-magnet synchronous motor from the error variable of the current reference Iref and the measured stator current 13. The current regulator operates in an orthogonal d, q coordinate system rotating along with the rotor of the permanent-magnet synchronous motor 1, the q axis of which system is in the direction of the torque axis of the permanent-magnet synchronous motor. The measured current 13 is converted into direct-current magnitudes of the d, q coordinate system in conversion segment 27 and the control voltage is converted from d, q direct-current magnitudes back into three-phase magnitudes in conversion segment 19. For this purpose the cascade regulator also comprises a feedback for position information 28 about the relative position of the rotor and the stator.

A program module 40 is added to the software of the frequency converter 10, which program module analyzes the operating condition of the parts driven with the permanent-magnet synchronous motor 1, such as the rotor bearings, the elevator ropes 31, the diverting pulleys 11, et cetera, from the signals of the cascade regulator 15. In the following this analysis of operating condition is presented in more detail.

Figure 4A:
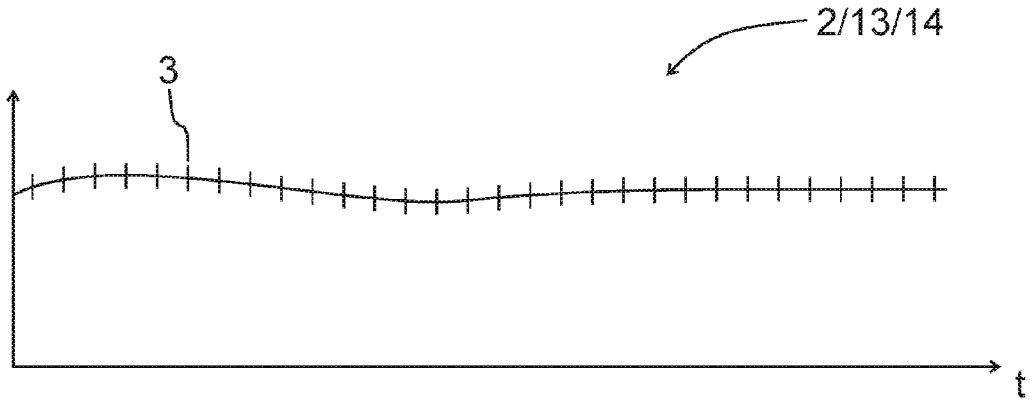
FIGS. 4*a* and 4*b* illustrate a possible determination method for determining the frequency components of the control signal of a drive device
Figure 4B:
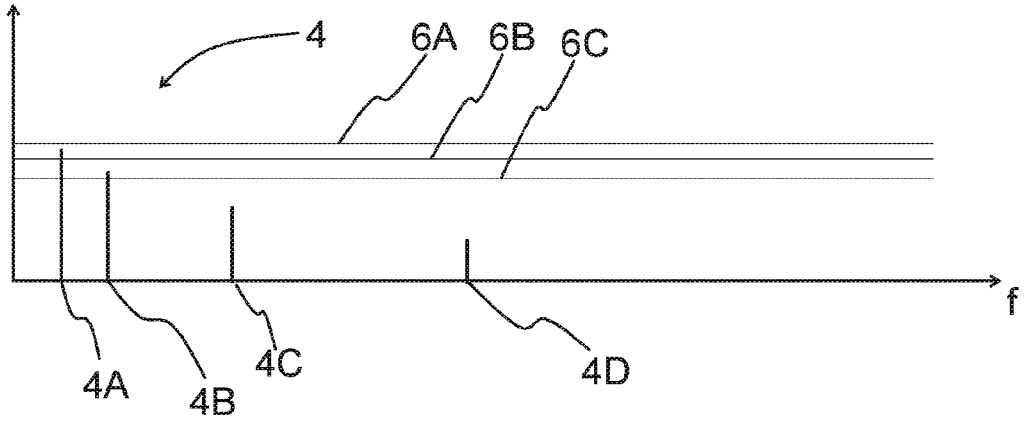

In FIG. 4*a* the control signal of the cascade regulator 15 described above is presented, which control signal can be e.g. a movement signal 2 of the traction sheave, a stator current signal 13 in the d, q coordinate system, or the stator voltage reference 14 in the d, q coordinate system. Samples 3 of the control signal 2, 13, 14 are taken at regular intervals and from the series of samples taken, i.e. from consecutive samples 3, a frequency component is determined that is characteristic to a rotating part of the elevator assembly driven with the permanent-magnet synchronous motor 1. The frequency components to be determined are selected on the basis of the speed of rotation of the rotor of the permanent-magnet synchronous motor and utilizing information about the transmission ratios between different parts. FIG. 4*b* presents some possible frequency components, when the frequency increases in FIG. 4*b* from the left to the right. The first frequency component 4A is the same as the rotational frequency of the traction sheave 5; the gradually increasing frequency component appearing at this frequency indicates, inter alia, a deterioration of the condition of a rotor bearing. The second frequency component 4B is twice the rotational frequency of the traction sheave 5; the frequency component occurring at this frequency can be caused from, inter alia, a measuring error of the rotor angle when using an absolute sensor for measuring the angle. The third frequency component 4C occurs at the rotational frequency of a diverting pulley and describes, inter alia, a bearing defect of a diverting pulley. The rotational frequency of a diverting pulley is proportional to the rotor frequency with a certain transmission, which is determined by, inter alia, the ratio of the diameters of the traction sheave and of the diverting pulley. The fourth frequency component 4D occurs at the electrical frequency of the rotor of the permanent-magnet synchronous motor 1, which electrical frequency is the same as the frequency of the magnetic flux circulating in the motor, and it indicates an asymmetry of the current circulating in the stator windings, from inter alia a direct-current component summed into an alternating current. In addition to the aforementioned frequencies, a deterioration of the operating condition can also be seen as an increase in other frequency components that are proportional to the rotational frequency of the rotor of the permanent-magnet synchronous motor 1.

The moment of sampling the control signal 2, 13, 14 of FIG. 4*a* is synchronized with the angle $\phi$ between the rotor and the stator of the permanent-magnet synchronous motor 1, such that the sample is taken always with the same value of the angle 4). In this way frequency components proportional to the rotor frequency and to multiples of the frequency can be separated from the collected/synchronized series of samples using a DFT (discrete Fourier transformation) algorithm without needing to process the aforementioned control signal with a prior-art window function before determining the frequency.

The operation of a DFT algorithm is per se known to a person skilled in the art and its not addressed separately in this context; let it be stated, however, that a DFT algorithm is used to separate a plurality of rotational frequencies of the rotor, and also frequency components proportional to the rotational frequency, which contain information about the operating condition of a rotating part of an elevator system.

By the aid of a DFT algorithm, a stopped vector presentation is obtained for the determined frequency components, which presentation describes the direction and amplitude of a component occurring at the frequency in question.

At each selected frequency the determined frequency component has the form:

$$a+bj$$

In this connection, the amplitudes of the frequency components 4A, 4B, 4C, 4D are checked, which amplitudes can be determined from the equation:

$$\sqrt{a^2+b^2}$$

As presented in FIG. 4*b*, limit values 6A, 6B, 6C are set for the frequency components, of which the limit value 6A sets the maximum permitted value for the amplitude of the rotational-frequency frequency component 4A of the rotor, the limit value 6B sets the maximum permitted value for the component 6B, the frequency of which is twice the rotational frequency of the rotor, and the limit value 6C sets the maximum permitted value for the value of the rotational-frequency frequency component 4C of the diverting pulley 11. The frequency converter 10 determines the aforementioned frequency components 4A, 4B, 4C, 4D during a run with the elevator, and compares the amplitudes of the frequency components to the limit values 6A, 6B, 6C for the maximum permitted amplitude. If the amplitude of a frequency component 4A, 4B, 4C, 4D increases to be larger than the limit value 6A, 6B, 6C set for the frequency component, the frequency converter 10 deduces that the part, for which the frequency component in question that is exceeding the limit value is characteristic, has failed. In this case the frequency converter also forms a monitoring signal for sending to a service center, in which monitoring signal the type of the failed part is indicated. In some embodiments the elevator control unit 20 also changes the movement profile 9 of the elevator car such that the nominal speed of the elevator car is reduced, such that the amplitude of the frequency component exceeding the aforementioned permitted value decreases again to below the maximum permitted value. In this case when determining a frequency component it must, of course, be taken into account that the frequency of the component to be determined decreases in proportion to a decrease in the speed of the elevator car.

In some embodiments the frequency converter also calculates, based on the magnitude of the overshoot of a permitted range of a frequency component, an estimate for the remaining service life of a part having a deteriorated operating condition such that the greater is the overshoot, the shorter is the remaining service life of the part in question. If the overshoot is large enough, the frequency converter can also transfer to a mode preventing the next run for preventing a dangerous situation. Information about the remaining service life/run prevention is also sent to a service center.

Embodiment 2

Figure 3:
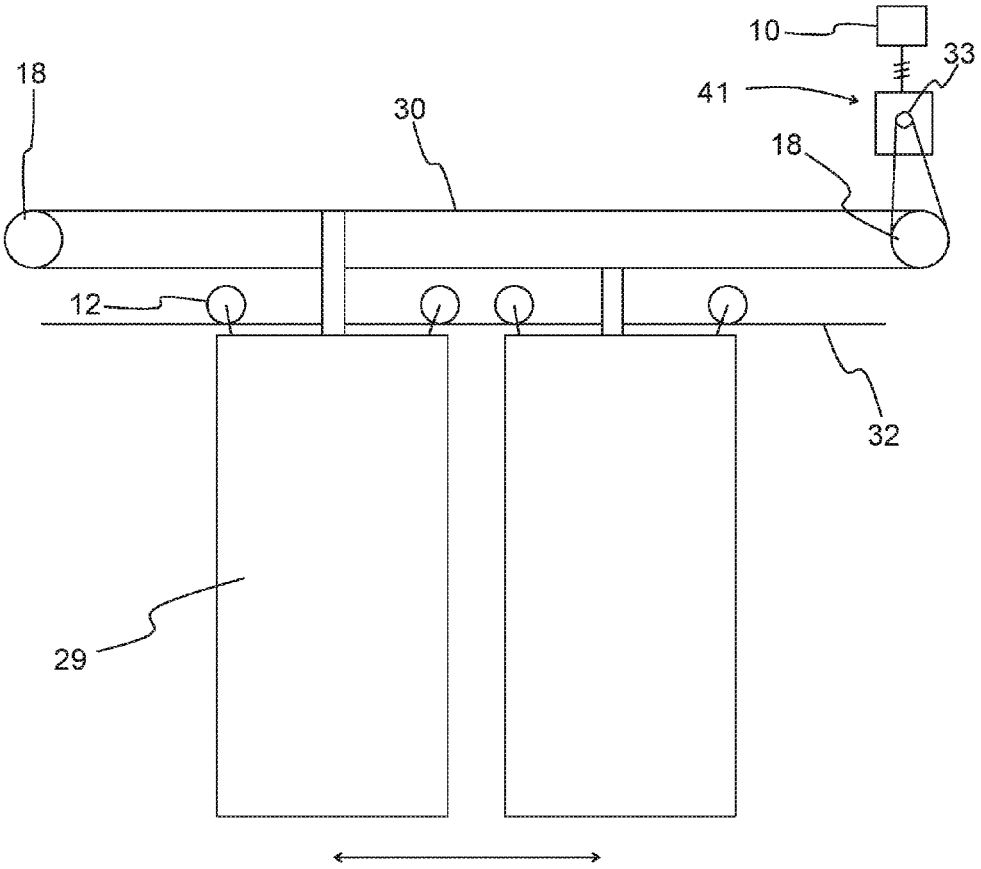
FIG. 3 illustrates a door operator according to the invention

In the embodiment of the invention according to FIG. 3 the door operator of the elevator car comprises an electric motor 1, preferably a brushless direct-current motor, onto the rotor of which a traction sheave 33 is connected with a shaft, which traction sheave is further connected to a diverting pulley 18 of the door operator with a belt drive. A second belt travels between the diverting pulleys 18 of the door operator, to which second belt the door panels 29 are fastened such that the door panels can be moved in the direction of the arrows marked in FIG. 3 towards each other and away from each other for opening and closing the doors.

The traction sheave 33 of the door operator is driven with a frequency converter 10. The rotor of the brushless direct-current motor 41 is magnetized with permanent magnets, and regulation of the brushless direct-current motor is implemented with the cascade regulator 15 presented in connection with the embodiment of FIG. 2, which cascade regulator is recorded in the software of the frequency converter 10. The software of the frequency converter also comprises a program module, which is similar to what is presented above in connection with the embodiments of FIGS. 2 and 4. The program module analyzes the operating condition of the parts driven with the brushless direct-current motor 41, such as the bearings of the motor 41, the bearings of the diverting pulleys 18 of the door operator and also the track rollers 12 of the doors, as is presented above. Since the analysis occurs on the basis of the frequency components characteristic to the aforementioned rotating parts of the door operator in essentially the same manner as was presented in connection with embodiments 2 and 4, it is not presented again in this context. In this embodiment of the invention the sampling frequency D of the control signal is synchronized with the angle $\phi$ between the rotor and the stator of the brushless direct-current motor 41.

Further, determination of the frequency components 4A, 4B, 4C, 4D is implemented with a DFT algorithm, but the frequency components can also be determined using some known spectrum determination method, such as an FFT algorithm. A DFT algorithm can also be implemented by taking samples from the control signal at regular intervals, without synchronizing the sampling frequency with the rotational frequency. In this case, however, it is necessary to preprocess the control signal with a prior-art window function before determination of the frequency components.

By means of the solution according to the invention the operating condition of other than rotating parts can also be monitored. For example, the operating condition of a frequency converter or the operating condition of a current supply circuit of a brake of an elevator can be monitored by determining the magnitude of harmonic components from the measuring signal of the intermediate circuit voltage of the current supply circuit of the frequency converter/brake.

The invention is described above by the aid of a few examples of its embodiment. It is obvious to the person skilled in the art that the invention is not only limited to the embodiments described above, but that many other applications are possible within the scope of the inventive concept defined by the claims.

The invention claimed is:

1. A method for monitoring the operating condition of an elevator system, comprising the steps of:

taking samples of a control signal of a drive device of an elevator;

determining from the series of samples taken a frequency component that is characteristic to a part of the elevator assembly driven with the drive device; and monitoring the operating condition of the part of the elevator assembly on the basis of the determined frequency component, wherein the control signal is speed input and output signals of a frequency converter that includes a cascade speed regulator controlling a speed of said part of the elevator assembly driven with the drive device.

2. The method according to claim 1, further comprising the steps of:

forming one or more limit values for the frequency components;

comparing the one or more limit values to the determined frequency component; and monitoring the operating condition of the part of the elevator assembly on the basis of the comparison.

3. The method according to claim 2, further comprising the step of:

if the determined frequency component deviates from a permitted range specified with the limit values, deducing that the operating condition of the part in question of the elevator assembly has deteriorated.

4. The method according to claim 3, further comprising the steps of:

determining the remaining service life of a part of the elevator assembly based on the magnitude of the deviation from the permitted range of the determined frequency component; and forming a monitoring signal for indicating the remaining service life of the part of the elevator assembly.

5. The method according to claim 1 further comprising the step of:

if it is detected that the operating condition of the part of the elevator assembly has deteriorated, forming a monitoring signal for specifying the part of the elevator assembly having a deteriorated operating condition.

6. The method according to claim 1 wherein the drive device is an electric motor and said method further comprises the steps of:

synchronizing the moment of sampling the control signal of the electric motor with the angle between the rotor and the stator of the electric motor; and determining a frequency component from the series of samples using a DFT algorithm.

7. The method according to claim 1 further comprising the steps of:

adjusting the movement of a rotating part of the elevator assembly with the drive device according to a movement profile to be determined for the movement of the rotating part;

monitoring the operating condition of the rotating part of the elevator assembly; and changing the movement profile of the rotating part of the elevator assembly on the basis of a change detected in the operating condition of the rotating part of the elevator assembly.

8. The method according to claim 7, further comprising the step of:

adjusting a frequency component characteristic to a rotating part of an elevator assembly towards a permitted range of the frequency component by changing the movement profile of the rotating part of the elevator assembly in response to the magnitude of the deviation from the permitted range of the frequency component determined from the series of samples.

9. The method according to claim 1 further comprising the steps of:

taking samples of the control signal of the drive device of the elevator when driving one or more parts of the elevator assembly with the drive device;

selecting a plurality of frequency components characteristic to one or more parts of the elevator assembly;

determining the frequency components from the series of samples taken; and monitoring the operating condition of the one or more parts in question of the elevator assembly on the basis of the determined frequency components.

10. An elevator system, comprising:

a controllable drive device, which is configured to drive one or more parts of an elevator assembly; and a control device for controlling the drive device, wherein the control device is configured to perform the method according to claim 1 for monitoring the operating condition of the elevator system.

11. The elevator system according to claim 10, wherein the drive device is an electric motor of a hoisting machine of an elevator.

12. The elevator system according to claim 11, wherein a part of the elevator assembly is the traction sheave of the hoisting machine.

13. The elevator system according to claim 11, wherein a part of the elevator assembly is a diverting pulley of an elevator.

14. The elevator system according to claim 10, wherein the drive device is an electric motor of a door operator of an elevator.

15. The elevator system according to claim 14, wherein a part of the elevator assembly is a traction sheave of a door operator of an elevator.

16. The method according to claim 2, further comprising the step of:

if it is detected that the operating condition of the part of the elevator assembly has deteriorated, forming a monitoring signal for specifying the part of the elevator assembly having a deteriorated operating condition.

17. The method according to claim 3, further comprising the step of:

if it is detected that the operating condition of the part of the elevator assembly has deteriorated, forming a monitoring signal for specifying the part of the elevator assembly having a deteriorated operating condition.

18. The method according to claim 4, further comprising the step of:

if it is detected that the operating condition of the part of the elevator assembly has deteriorated, forming a monitoring signal for specifying the part of the elevator assembly having a deteriorated operating condition.

19. The method according to claim 2 wherein the drive device is an electric motor and said method further comprises the steps of:

synchronizing the moment of sampling the control signal of the electric motor with the angle between the rotor and the stator of the electric motor; and determining a frequency component from the series of samples using a DFT algorithm.

20. A method for monitoring the operating condition of an elevator system including an elevator cart, comprising the steps of:

taking samples of a control signal of a motor of an elevator which drives the elevator cart to move;

determining, from the series of samples taken, a frequency component that is characteristic to at least a rotating part of the elevator assembly driven by the motor, the rotating part being at least one of a traction sheave of a hoisting machine, via which ropes pass to suspend the elevator cart, and a diverting pulley, via which ropes pass into connection with the elevator cart; and monitoring the operating condition of the part of the elevator assembly on the basis of the determined frequency component.

* * * * *